United States Patent [19]

Bush

[11] Patent Number: 4,676,885

[45] Date of Patent: Jun. 30, 1987

[54] SELECTIVE PROCESS FOR THE UPGRADING OF DISTILLATE TRANSPORTATION FUEL

[75] Inventor: Warren V. Bush, Houston, Tex.

[73] Assignee: Shell Oil Company, Houston, Tex.

[21] Appl. No.: 867,666

[22] Filed: May 28, 1986

[51] Int. Cl.[4] ..... C10G 69/02

[52] U.S. Cl. ..... 208/49; 208/15; 585/317; 585/324; 585/353; 585/379; 585/643; 585/645; 585/700; 585/708

[58] Field of Search ..... 208/49, 15, 17, 16; 585/317, 318, 310, 324, 379, 476, 643, 645, 700, 708

[56] References Cited

U.S. PATENT DOCUMENTS

| | | | |
|---|---|---|---|
| 3,136,825 | 6/1964 | Ryan et al. | 208/134 |
| 3,281,351 | 10/1966 | Gilliland et al. | 208/67 |
| 3,290,406 | 12/1966 | Pfefferle | 260/683.3 |
| 3,306,706 | 2/1967 | Schuman | 585/379 |
| 3,328,289 | 6/1967 | Streed | 208/15 |
| 3,345,285 | 10/1967 | Hutto et al. | 208/67 |
| 3,445,541 | 5/1969 | Heckelsberg et al. | 260/683 |
| 3,607,728 | 9/1971 | Wilhelm | 208/57 |
| 3,617,511 | 11/1971 | Jenkins et al. | 208/57 |
| 3,641,174 | 2/1972 | Lyons | 260/666 A |
| 3,692,863 | 9/1972 | Kmecak et al. | 208/49 |
| 3,763,032 | 10/1973 | Banks | 208/49 |
| 3,791,961 | 2/1974 | Sinfelt | 208/65 |
| 3,917,540 | 11/1975 | Pollitzer | 208/138 |
| 4,133,842 | 1/1979 | Anderson | 208/49 |
| 4,312,792 | 1/1982 | Antos | 585/379 |
| 4,368,345 | 1/1983 | Dickinson | 585/643 |
| 4,501,653 | 2/1985 | Hamner | 208/15 |
| 4,523,045 | 6/1985 | Vora | 585/324 |

*Primary Examiner*—Andrew H. Metz
*Assistant Examiner*—Anthony McFarlane
*Attorney, Agent, or Firm*—Kimbley L. Muller

[57] ABSTRACT

The invention disclosed herein comprises a process for the selective upgrading of combustion quality of a distillate transportation fuel by careful selective dehydrogenation, disproportionation and hydrogenation to convert cycloparaffinic materials contained in the distillate transportation fuel to acyclic paraffinic hydrocarbons, wherein said conversion is undertaken by first forming cyclomonoolefinic hydrocarbons from cycloparaffinic hydrocarbons via dehydrogenation, disproportionating the cyclomonoolefinic hydrocarbons to acyclic di-α-olefin hydrocarbons and then selectively hydrogenating said di-α-olefin hydrocarbons in the presence of hydrogen to saturate the double bonds of the di-α-olefin to form acyclic paraffinic hydrocarbons. The selective disproportionation reaction includes the addition of ethylene or an ethylene acting material to ring open the cyclomonoolefinic material. The reaction may be undertaken in either a single stage vessel, or in a three stage vessel having three unitary reaction areas comprising first, a dehydrogenation zone, second, a disproportionation zone and third, a hydrogenation zone.

51 Claims, 2 Drawing Figures

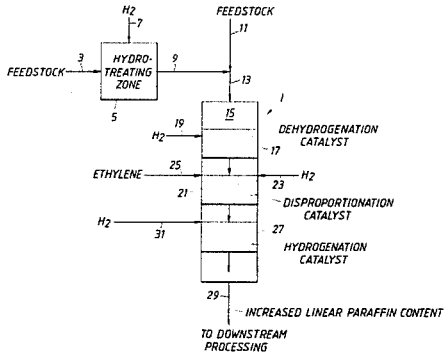

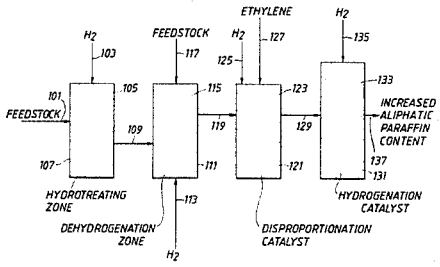

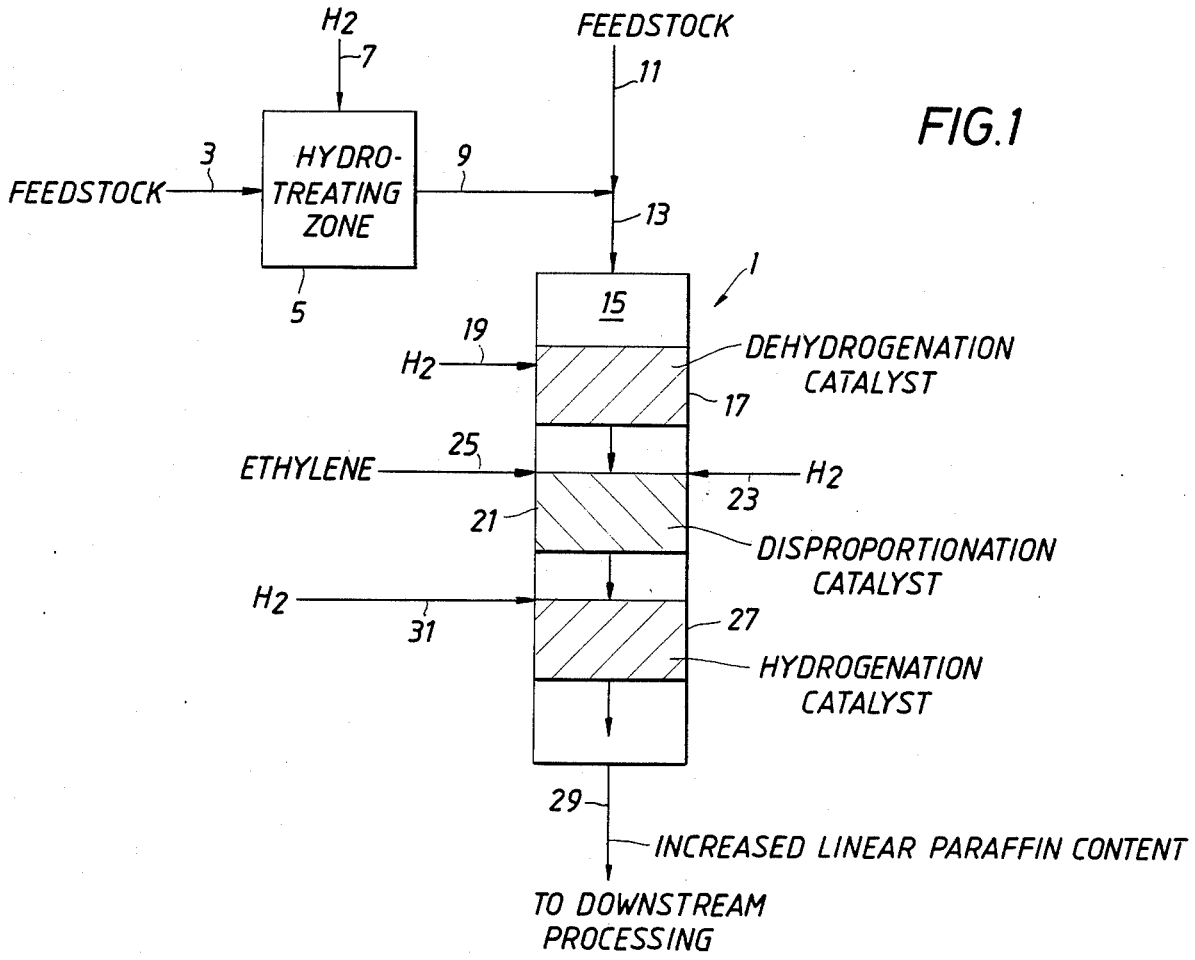
H2
7
FEEDSTOCK
11
FIG.1
3
HYDRO-
TREATING
ZONE
9
FEEDSTOCK
13
1
5
15
19
H2
DEHYDROGENATION
CATALYST
17
25
ETHYLENE
H2
23
21
DISPROPORTIONATION
CATALYST
H2
31
27
HYDROGENATION
CATALYST
29
INCREASED LINEAR PARAFFIN CONTENT
TO DOWNSTREAM
PROCESSING

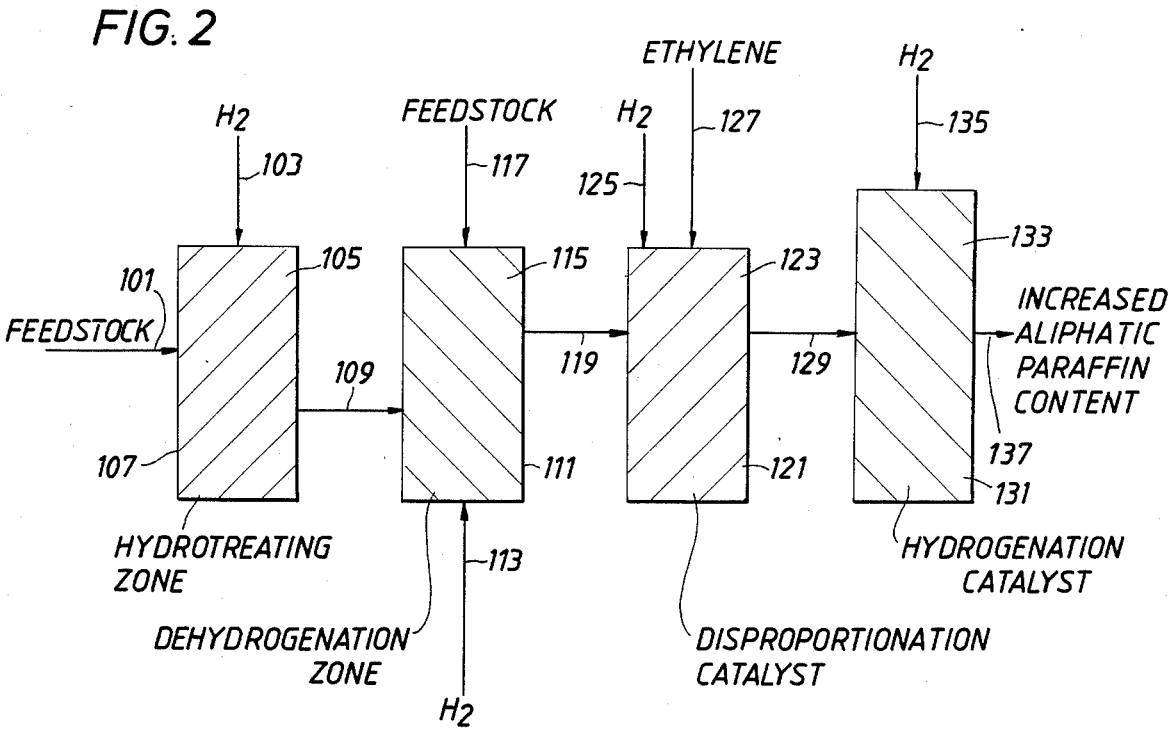
FIG. 2
ETHYLENE
H2
H2
FEEDSTOCK
H2
127
135
103
117
125
133
101
105
115
123
INCREASED
ALIPHATIC
PARAFFIN
CONTENT
FEEDSTOCK
109
119
129
107
111
121
137
131
HYDROTREATING
ZONE
113
HYDROGENATION
CATALYST
DEHYDROGENATION
ZONE
DISPROPORTIONATION
CATALYST
H2

SELECTIVE PROCESS FOR THE UPGRADING OF DISTILLATE TRANSPORTATION FUEL

FIELD OF THE INVENTION

The field of this invention concerns the upgrading of the combustion quality of certain petroleum substrates commonly known as distillate transportation fuels, or the blending components thereof. These are generally classified as aviation turbine fuel, diesel fuel, or kerosene having boiling points of from about 300° F. to about 900° F. Nature has provided that all types of crude oil have different indigenous properties which require specialized refining in order to maximize the quantity of desired combustible material from the particular feedstock. Some of the crude oils derived via exploration and production are highly naphthenic crudes which are difficult to refine into distillate transportation fuel, yet lend themselves readily to the production of gasoline. The field of this invention concerns a method whereby a highly naphthenic crude oil, such as derived on the West Coast of the United States, can be upgraded to higher combustion qualities.

It is desirable to increase this combustion quality without a decrease in the molecular weight. Most hydrogen-active or cracking catalysts cannot readily distinguish one carbon-carbon bond in a ring from another carbon-carbon bond in an aliphatic compound, hence, simple hydrogenolysis or catalytic cracking or hydrocracking may provide some ring opening benefits, but these processes suffer terribly from the loss of hydrocarbon material from the desired boiling range. Ring compounds of a saturated nature, such as naphthenes, are deleterious to the combustion quality of distillate transportation fuels. It would be most desirable to derive a process sequence which would allow conversion of these naphthenes in the fuel to aliphatic paraffinic hydrocarbons without diminishment of other hydrocarbons by means of cracking. This invention seeks to perform that task.

BACKGROUND OF THE INVENTION

Various catalyzed dehydrogenation, disproportionation and dehydrogenation steps have been existent in the prior art for many years. This invention brings a selective controlled sequence of these known steps at relatively mild treating conditions to convert cycloparaffinic material to aliphatic paraffinic material with the substantial exclusion of conversion to lower boiling compounds of other hydrocarbon materials present in the diesel fuel, aviation turbine fuel or kerosene.

A process for the dehydrogenation of cyclic paraffins is described in U.S. Pat. No. 3,290,406 issued to Pfefferle to produce olefins or diolefins from the dehydrogenation. A selective permeable membrane acts to keep hydrogen partial pressure in the dehydrogenation zone low and therefore increase the rate of dehydrogenation at lower temperatures. While this patent teaches general dehydrogenation over a catalyst, there is no mention of combining this dehydrogenation with disportionation and re-hydrogenation to acquire aliphatic paraffinic materials from naphthenic materials. A combination of naphtha cracking (pyrolysis), olefin disproportionation and olefinic dehydrogenation is taught in U.S. Pat. No. 3,345,285 issued to Hutt et al, wherein a naphtha is converted to ethylene, butadiene and gasoline by naphtha cracking, olefin disproportionation and then olefin dehydrogenation to the diolefinic material. This prior art process applies to the dehydrogenation of a $C_4$ olefin, not to a cycloparaffin, and is applied to a finishing step, not as a feed preparation to a disproportionation step. One significant teaching in this reference is that ethylene is preferred to be used in a disproportionation reaction. However, ethane and methane mixed with hydrogen can be used in place of the ethylene in the disproportionation step. This is similar to applicant's feed material for the disproportionation step and is herein incorporated by reference to exemplify a specific type of olefin-acting material as therein taught.

In Sinfelt, U.S. Pat. No. 3,791,961, aromatics are produced from naphthenes by a dual catalyst system whereby naphthenes are dehydrogenated in an initial reaction zone while a second zone converts paraffins, along with dealkylation of alkyl benzenes, to acquire additional aromatic hydrocarbons. In this disclosure, the dual catalyst converts aliphatics and cyclic paraffins to aromatics. A combination dehydrogenation and disproportionation catalyst has been taught to function in a single reaction vessel such as described in U.S. Pat. No. 3,445,541, issued to Heckelsberg et al, wherein propane is used to prepare an olefin feed for disproportionation. This teaching is significant in the showing that disproportionation and dehydrogenation can, if desired, occur in a single vessel, however, the dehydrogenation of this prior disclosure is reserved to acyclic hydrocarbons, i.e. they do not concern the function of a ring opening material. Another olefin disproportionation reaction concerning acyclic materials is shown in U.S. Pat. No. 3,281,351 issued to Gilliland et al, for the conversion of propylene to ethylene and butylene with the latter being dehydrogenated to butadiene. Preliminary dehydrogenation and subsequent hydrogenation function of the instant invention concerning the conversion of cycloparaffinic materials to aliphatic paraffinic materials is not disclosed. A homogeneous catalyst for the disproportionation of olefins is described in U.S. Pat. No. 3,641,174, issued to Lyons, but does not refer to a ring opening reaction, in order to guarantee the patentee's disproportionation. For example, the patentee begins the reaction with a cyclic diolefin material to produce an aromatic material and a monoolefinic cyclic material. In contrast, the instant invention begins, in the disproportionation reaction, with ethylene and a cyclic monoolefin to arrive at an acyclic di-α-olefin. None of the instant disproportionation reactions actually refer to a selective ring opening function, especially one acting on a cyclic monoolefinic material derived from the dehydrogenation of a naphthene.

OBJECTS AND EMBODIMENTS

It is therefore an object of this invention to treat naphthenecontaining feedstocks to acquire a distillate transportation fuel having an upgrade of combustion qualities.

Another object of this invention is to provide a sequential hydrocarbon conversion comprising dehydrogenation, disproportionation and hydrogenation to upgrade the quality of a distillate transportation fuel.

Another object of this invention is to treat an aviation turbine fuel or diesel fuel with a dehydrogenation catalytic function to acquire an aviation turbine fuel or diesel fuel having a diminished content of naphthenes and an increased quantity of cyclomonoolefinic hydrocarbons, which may be disproportionated in the presence of a disproportionation catalyst and an olefin to acquire an increased quantity of acyclic di-α-olefin and a reduced quantity of cyclomonoolefinic hydrocarbons (as compared to the dehydrogenation effluent) and subsequently hydrogenating the acyclic di-α-olefin hydrocarbon to stabilize the same.

Another object of this invention is to provide a process to upgrade the combustion quality of an aviation turbine fuel or a diesel fuel having an increased quantity of di-α-olefin hydrocarbons, which are then stabilized by a hydrogenation process, whereby potential gum-forming problems are obviated by hydrogenating stabilization.

Another object of this invention is to provide a sequential dehydrogenation, disproportionation and hydrogenation process under relatively mild operating conditions so as to convert a portion of the undesirable naphthenes in a distillate transportation fuel to desirable acyclic hydrocarbons.

Another object of this invention is to provide a sequential hydroconversion process having a unitary reaction vessel with three different catalytic beds in respective sequence of dehydrogenation, disproportionation and hydrogenation whereby the linear acyclic paraffin content of the feedstream is increased after passage over these three catalytic beds.

Another object of this invention is to provide a unitary vessel with three functioning catalysts, all in a physical admixture therein, having respectively a dehydrogenation, disproportionation and hydrogenation function whereby a feedstream having naphthenes therein is simultaneously dehydrogenated, disproportionated and hydrogenated to increase the relative quantity of acyclic paraffinic hydrocarbons via the conversion of the naphthene materials.

Another object of this invention is to provide a sequential process for the conversion of naphthenes in a distillate transportation fuel selected from the group consisting of aviation turbine fuel, diesel fuel and kerosene in three separate reactor units having respectively a first dehydrogenation catalyst, a second disproportionation catalyst, and third a hydrogenation catalyst, wherein the reaction conditions are selected in the respective vessels so as to first convert the naphthenes in the first dehydrogenation step to cyclomonoolefinic hydrocarbons, second convert the cyclomonoolefinic hydrocarbons, at disproportionation conditions, to acyclic di-α-olefin material and third, hydrogenation of di-α-olefinic material, under mild hydrogenation conditions, in the presence of a catalyst having a hydrogenation function, to saturate the terminal double bonds of the di-α-olefin and thereby stabilize the distillate transporation fuel.

One embodiment of this invention resides in a process for the selective upgrading of combustion quality of a distillate transportation fuel comprising aviation turbine fuel (ATF), diesel fuel and kerosene by selectively dehydrogenating said cycloparaffinic hydrocarbons in the presence of a dehydrogenation catalyst and at dehydrogenation reaction conditions selective to convert the cycloparaffinic hydrocarbons to cyclomonoolefinic hydrocarbons, selectively disproportionating said cyclomonoolefinic hydrocarbons by contact with a hydrocarbon comprising ethylene in the presence of a ring opening disproportionation catalyst, and at disproportionation conditions selective to open said cyclomonoolefinic hydrocarbons, to produce a linear acyclic di-α-olefin hydrocarbons, and selectively hydrogenating the acyclic di-α-olefins in the presence of hydrogen and a hydrogenation catalyst to saturate said acyclic di-αolefins, at hydrogenation conditions, effective to produce acyclic paraffinic hydrocarbon.

Another embodiment of this invention resides in a process for the selective conversion of cycloparaffinic hydrocarbons in the presence of non-cycloparaffinic hydrocarbons which comprises contacting said cycloparaffinic and non-cycloparaffinic hydrocarbons with a dehydrogenation catalyst at dehydrogenation conditions selected to convert the cycloparaffinic hydrocarbons to cyclomonoolefinic hydrocarbons to the near substantial exclusion of conversion of the non-cycloparaffinic hydrocarbons and recovering the non-cycloparaffinic hydrocarbons and produced cyclomonoolefinic hydrocarbons and, contacting the recovered non-cycloparaffinic hydrocarbons and cyclomonoolefinic hydrocarbons with a disproportionation catalyst, at disproportionation conditions selected to convert the cyclomonoolefinic hydrocarbons, in the presence of a lower olefinic compound, such as ethylene, to form a ring-opened acyclic di-α-olefin hydrocarbon to the near substantial exclusion of conversion of the non-cycloparaffinic hydrocarbons.

The definition of the term near substantial exclusion of conversion of the non-cycloparaffinic hydrocarbons is conversion of less than 10% by weight of the non-cycloparaffinic hydrocarbons. In this manner the remaining more than 90% by weight of the non-cycloparaffinic hydrocarbons can insure their combustion enhancing qualities to the transportation fuel, which is an improvement over the former hydrogenolysis or catalytic cracking of past processes to enhance combustion qualities.

Another embodiment of this invention resides in a three stage hydrocarbon conversion process for the selective conversion of cycloparaffins to acyclic paraffins, wherein said conversion is performed on a distillate transportation fuel selected from the group of diesel fuel, aviation turbine fuel and kerosene in a multiple stage unitary apparatus comprising (1) a distillate fuel, ethylene and hydrogen inlet, (2) three sequential reaction zones comprising a first dehydrogenation zone, a second disproportionation zone and a third hydrogenation zone, wherein distillate fuel is added to said first dehydrogenation zone, ethylene is added to said second disproportionation zone and hydrogen is added to said third hydrogenation zone, or both the third hydrogenation zone and the first dehydrogenation zone, and (3) a distillate transportation fuel outlet, wherein distillate transportation fuel of higher combustion quality is removed from said outlet than was added to said first dehydrogenation zone, which process comprises passing the distillate transportation fuel containing said cycloparaffins to the first dehydrogenation zone containing a dehydrogenation catalyst and maintained at dehydrogenation conditions of from 500° to 1500° F., a pressure of from 0 to 1500 psig and a gas hourly space velocity (GHSV) of 200 to 1000 sufficient to unsaturate said cycloparaffins and convert at least a portion of said cycloparaffins to cyclomonoolefins, removing from said dehydrogenation zone the distillate transportation fuel having a decreased amount of cycloparaffins and an increased amount of cyclomonoolefins, passing the removed distillate transportation fuel derived from the first dehydrogenation zone to a second disproportionation zone and adding to the second disproportionation zone ethylene, in a stoichiometric amount of from 0.1:1 to about 100:1, wherein the second disproportionation zone contains a disproportionation catalyst and is maintained at disproportionation reaction conditions of from 300° to 1000° F., a pressure of from 0 to 1500 psig and gas hourly space velocity (GSHV) of 200 to 1000 sufficient to open the ring of the cyclomonoolefinic molecule and increase unsaturation to form an acyclic di-α-olefin and to form a distillate transportation fuel having a decreased amount of cyclomonoolefins and an increased quantity of acyclic di-α-olefins, the distillate transportation fuel being removed from said second disproportionation zone, and passing the removed distillate transportation fuel to a third hydrogenation zone and adding hydrogen sufficient to insure a hydrogen partial pressure of at least 200 psia, wherein the third hydrogenation zone contains a hydrogenation catalyst and is maintained at a temperature of from 0° to 1000° F., a pressure of from 0 to 1500 psig and a gas hourly space velocity (GHSV) of 200 to 1000 sufficient to hydrogenate said terminal bonds of said acyclic di-α-olefin to form acyclic paraffins and thereby to prepare a distillate transportation fuel having an increased quantity of acyclic paraffins, which results in an increase in the combustion quality of the distillate transportation fuel.

Another embodiment of this invention resides in a process for the selective upgrading of combustion quality of a distillate transportation fuel in a common single-stage process vessel which comprises passing said distillate transportation fuel to said unitary vessel containing a tripartite function catalyst having hydrogenation, dehydrogenation and disproportionation functions and maintained at a temperature of from about 500° to 1000° F., a pressure of about 0 to 1500 psig, a partial pressure of hydrogen at least 1000 psia and a gas hourly space velocity (GHSV) of 200 to 1000 to selectively convert cycloparaffinic hydrocarbons contained in the distillate transportation fuel to acyclic hydrocarbons by first dehydrogenating the cycloparaffins to cyclomonoolefins, disproportionating the cyclomonoolefins to acyclic di-α-olefins in the presence of added ethylene, and selectively hydrogenating the acyclic di-α-olefins in the presence of hydrogen to saturate the acyclic di-α-olefins to produce an increased content of acyclic paraffinic hydrocarbon.

BRIEF DESCRIPTION OF THE INVENTION

This invention deals with the deliberate formation of a cyclic monoolefin from a naphthenic compound contained in a distillate transportation fuel or blending component thereof, and subsequent ring opening of the monoolefinic material by disproportionation to an acyclic di-α-olefin and then hydrogenation to stabilize the same. This process results in a distillate transportation fuel having an upgrade of combustion quality.

DETAILED DESCRIPTION OF THE INVENTION

As shown in FIGS. 1 and 2 of the instant drawings, this invention deals with a tripartite hydrocarbon conversion process whereby a first dehydrogenation function, a second disproportionation function and a third hydrogenation function are linked to upgrade the combustion quality of a distillate transportation fuel or blending component thereof originally having an undesirably high content of naphthenes.

The distillate transportation fuels of the instant invention are the preferred feed materials for the dehydrogenation step. These distillate transportation fuels or blending components thereof will usually have undesirable content of naphthenic hydrocarbons ranging from 50% to about 80%. Normally, these distillate transportation fuels are nomenclated as aviation turbine fuel (ATF), diesel fuel, and kerosene, or blending components thereof. The boiling point range fo these distillate transportation fuels will usually comprise 300° F. to 530° F. for ATF, 310° F. to 650° F. for diesel fuel and 320° F. to 550° F. for a kerosene fuel. While this invention may be applicable to other petroleum distillates boiling below 300° F., it is preferred that the upgrading of the combustion quality will only have an effect on feed material within the particular boiling range as a result of the object to be achieved herein, i.e., the conversion of naphthenic hydrocarbons to acyclic paraffinic hydrocarbons.

In another variation of this process it is also feasible to treat a transportation fuel or its precursor to convert some of the aromatics present therein to naphthenes. After this particular type of treatment the enhanced quantity of naphthenes are then converted to acyclic paraffinic molecules by the three step dehydrogenation, disproportionation and hydrogenation functions of this process.

The distillate transportation fuel will contain naphthenes with carbon rings having 4 to 8 carbon atoms in the ring, with the predominant material having 5-carbon and 6-carbon rings, i.e. cyclopentanes or cyclohexanes. It is important that the dehydrogenation step be controlled selectively, especially where the $C_6$-cycloparaffin is concerned, so that the saturated cyclic hydrocarbon is not converted to the triolefin or aromatic material but is instead converted to a $C_6$ monoolefinic cyclic hydrocarbon, such as cyclohexene.

The naphthenic molecules treated here are usually indigenous to the petroleum mineral. The carbon number of the cycloparaffin molecules may range from as low as 7 to as high as 25. Most, if not all, of the cycloparaffins will be $C_5$ and $C_6$ cycloparaffins but these may have relatively long chain alkyl substituents thereby raising the total carbon number to as many as 25. While it is possible that some $C_3$ and $C_4$ cycloparaffins may be present in the petroleum mineral, it is rare and the same would not render nugatory the effect of the instant process.

The dehydrogenation step is chosen with particular reference to the dehydrogenation catalyst and the dehydrogenation conditions to selectively ensure formation of the cyclic monoolefinic material. One of reasonable skill in the art will be able to select a particular catalyst for this dehydrogenation reactor from those existent in the art and also choose the particular dehydrogenation conditions to ensure cycloparaffin to cycloolefin conversion. Examples of suitable catalysts for the dehydrogenation reaction include metallic catalyst dispersed on an inorganic oxide support such as alumina, silica, alumina-silica admixtures, etc. The catalyst metals may be selected from Group VIII of the Periodic Table or Group VIB of the Periodic Table or combinations of both. Particular metals contemplated within the range of catalyst are iron, cobalt, nickel, ruthenium, rhodium, vanadium, osmium, irridium, platinum, palladium, molybdenum, tungsten, platinum-palladium, platinum-iridium, platinum-ruthenium, cobalt, iron, chromium-molybdenum, palladium-chromium, palladium-molybdenum, platinum-molybdenum, platinum-chrominum, iron-chromium, iron-chromium-nickel, etc. These catalysts may also be promoted by an alkali or alkali earth metal such as sodium, lithium, beryllium, magnesium, potassium, calcium, rubidium, strontium, etc. The weight content of these materials will vary with the particular dehydrogenation catalyst selected. Where a Group VIII metal is chosen, the Group VIII metal may be present in a range of 0.1 to 3 w% based on the total weight of the catalyst. Where a Group VIB metal is chosen, the catalyst may contain from 1 to 20 w% of the applicable metal. Where a combination of the Group VIII and Group VIB metal is concerned, a combination of these weight percents of the particular metals may be present. The promoter, usually a magnesium oxide, sodium oxide or potassium oxide can be present within a weight percent of 5 to 15 w%. Again, the reaction conditions during the dehydrogenation are chosen to selectively convert the naphthenes to cyclic monoolefins. A reaction temperature of from 500° to 1500° F., preferably from 800° to 1000° F., a pressure of 0 to 1500 psig, preferably 0 to 500 psig, and a GSHV of 200 to 1000 at STP are exemplary of such conditions to selectively convert the cycloparaffin to the cycloolefin. If desired, a small partial pressure of hydrogen can be added in a quantity of from 1 to 300 psia to mitigate coking on the dehydrogenation catalyst. It is important to recognize that if severe reaction conditions are coupled with a reactive catalyst, it is most probable that the dehydrogenation will drive the cycloparaffinic material to a hydrocarbon other than the cyclomonoolefinic material such as an aromatic material. While this may be desirable in the manufacture of gasolines, it is not desirable in the manufacture of distillate transportation fuel of the instant invention. After the naphthenic materials are converted to cyclic monoolefinic hydrocarbons, either in a unitary reaction or in sequential discrete reaction zones, the distillate transportation fuel will possess an increased quantity of cyclomonoolefinic hydrocarbons and a decreased quantity of cycloparaffinic hydrocarbons. This effluent from the dehydrogenation zone is then subjected to a selective disproportionation reaction to convert the cyclic monoolefinic materials to acyclic di-α-olefin hydrocarbons.

The di-α-olefinic hydrocarbons will be a derivative of the type of cyclic paraffinic hydrocarbons existent in the dehydrogenation step. If the cyclomonoolefinic material is for example a cyclic $C_6$ monoolefin, the resultant acyclic di-α-olefin hydrocarbon will contain the 1,7-octadiene carbon skeleton. Thus, the olefinic bonds will both be placed at the terminal positions relative to the ring opening and will have intermediate therewith from 2 to 8 carbon atoms. The second olefinic bond is established by the presence of an olefin-acting reactant, such as ethylene. It is also contemplated that other hydrocarbons, such as propylene or a combination of ethane, methane and hydrogen may be utilized to supply this extra alpha double bond, however, ethylene is the most desirable material. The carbon number of the acyclic diolefin product will have an increase in carbon number of two as compared to the naphthene feed. Thus, the ethylene acting molecule becomes chemically bound to the cyclomonoolefin during ring opening procedures. The preferred ethylene or ethylene acting reactant should be present in the disproportionation reaction zone in a stoichiometric quantity of about 0.1:1 to about 100:1 based on the content of the cyclic monoolefinic hydrocarbon.

The disproportionation catalyst can be selected from any suitable Group VIII metal alone or the same in combination with another disproportionation catalytic metal. Examples of such disproportionation catalysts will comprise tungsten or molybdenum dispersed on an inorganic oxide such as silica, alumina, or a combination of silica or alumina. The weight content of the catalytic metals should be between 1 and 15 wt % based on the total weight of the catalyst with 5 to 15 wt % being preferred. The disproportionation reaction conditions are selectively chosen to convert the cyclomonoolefinic hydrocarbon to acyclic di-α-olefin hydrocarbon via the ethylene or olefin-acting additive reactant. The disproportionation pressure need only be high enought to give a reasonable concentration of the reactants and a reasonable rate of reaction. The temperature should be above a certain threshold characteristic for the chosen individual disproportionation catalyst. The reaction conditions will include a temperature of 300° to 1100° F., preferably 600° to 900° F., a pressure of 0 to 1500 psig, preferably 200 to 600 psig, a GHSV of 200 to 1000 at STP and if desired, a hydrogen partial pressure, which acts as a diluent, may also be present. Once the acyclic di-α-olefin hydrocarbon exists, the conbustion quality of the distillate transportation fuel has been enhanced. However, because the olefinic bonds in the acyclic di-α-olefin have a propensity to form gum they should undergo hydrogenation to the paraffinic species. This is an important concern in a distillate transportation fuel, especially if storage is contemplated without inhibitors such as an alkyl-substituted phenylenediamine and the like, which adds expense to storage cost. It is desirable to further treat the distillate transportation fuel to substantially eliminate (saturate) the di-α-olefin hydrocarbon and arrive at an acyclic paraffinic hydrocarbon.

This hydrogenation step may be carried out in the presence of a selective hydrogenation catalyst, which may be a mirror reflection of the dehydrogenation catalyst of the first processing step, but at very mild conditions, to augment hydrogen atoms to both terminal positions of the acyclic chain and thereby remove the alpha-olefin double bond at the terminal position on both ends of the molecule. The mild hydrogenation conditions for this step are contemplated to be within 0° to 1000° F., preferably 200° to 600° F., a pressure of 0 to 1500 psig, preferably 500 to 1000 psig, a partial pressure of added hydrogen (in order to accomplish the hydrogenation function) to above 200 psia and preferably above 300 psia and a GHVS of 200 to 1000 at STP.

It may also be desirable that before any of the three sequential treatments, the distillate transportation fuel be treated by a hydrotreating process at a temperature of 550° F. to about 700° F., a pressure of about 600 psig to about 1000 psig, and a hydrogen partial pressure of about 500 psia to about 700 psia and liquid hourly space velocity (LHSV) of about 0.5 to about 3.0, to eliminate nefarious sulfur and nitrogen compounds from the feed material. These unwanted materials may act as poisons for dehydrogenation and disproportionation catalysts. It is also contemplated that standard fractionation and cooling units may be included in the process flow scheme, such as a cooling of the effluent from the disproportionation zone before selective hydrogenation of the produced acyclic di-α-olefin hydrocarbon. One salient advantage of this invention is that surplus ethylene may be readily derived in most refineries for use in the disproportionation reaction. For example, in a refinery, a rectified adsorber dry gas from a catalytic coking unit or a catalytic cracking unit may contain enough ethylene to adequately provide the disproportionation function to open the ring of the cyclomonoolefinic molecule and arrive at the di-α-olefin hydrocarbon.

BRIEF DESCRIPTION OF THE DRAWINGS

FIG. 1 is a schematic flow scheme of the tripartite sequential hydrocarbon conversion process including a dehydrogenation catalyst zone, a disproportionation catalyst zone and a hydrogenation catalyst zone.

FIG. 2 is a sequential flow scheme of the tripartite hydrocarbon conversion process having separate unitary reaction vessels for the particular functions which occur in the respective vessels.

DETAILED DESCRIPTION OF THE DRAWINGS

FIG. 1 demonstrates sequential dehydrogenation, disproportionation and hydrogenation functions in a unitary vessel having three separate catalyst beds. Each of these beds is connected or communicates with one another by means of any particular type of communication means such as conduits, downcomers, screens, etc. A feedstock, preferably a distillate transportation fuel, is added through conduit 3 to hydrotreating unit 5 containing any type of hydrotreating catalyst such as a nickel-molybdenum catalyst. This hydrotreating feed zone may contain layers of hydrotreating catalyst or one unitary hydrotreating catalyst in any particular shape, such as a pellet, extrudate, trilobe configuration, spherical configuration, etc. A relatively small quantity of hydrogen is added to hydrotreating zone 5 to treat, in the presence of the hydrotreating catalyst, the distillate transportation fuel to excise or convert heteroatoms therefrom inclusive of nitrogen and sulfur atoms. Hydrogen may be added to hydrotreater 5 by means of conduit 7. A desulfurized and denitrogenated distillate transportation fuel effluent is recovered in conduit 9 from hydrotreating zone 5 and passed directly to the sequential hydrocarbon reactor flow scheme through conduit 13. It is also contemplated, although not preferred, that an unhydrotreated feedstock may be added by means of conduit 11 directly to the sequential hydroconversion reactor flow scheme of this invention. It is most preferred that either virgin feedstock from conduit 11 or hydrotreated feedstock supplied by conduits 3, 9 and 13 be charged individually to hydroconversion reactor 1.

The hydrotreated or unhydrotreated distillate transportation fuel is passed to sequential hydroconversion reactor 1, which may have a manifold area for radial distribution of the distillate transportation fuel in prezone 15. Conduit 13 communicates with dehydrogenation reaction zone 17 through any applicable conventional means, such as a standard manifold or multiple entry points connecting manifold area 15 with dehydrogenation zone 17. The dehydrogenation catalyst is selected from any of the above-described catalysts but is preferably a catalyst comprising 0.1 to 3 wt % platinum dispersed on alumina or 1 to 20 wt % chromium oxide or iron oxide dispersed on alumina with magnesium oxide, potassium oxide or sodium oxide present as a promoter in a range of from 5 to 15 wt %. If desired, a small amount of hydrogen is added to the dehydrogenation zone via conduit 19, especially when the feedstock is derived, unhydrotreated from conduit 11. This small amount of hydrogen mitigates coking in the dehydrogenation reactor and preserves the life function of the applicable dehydrogenation catalyst. The dehydrogenation reaction temperatures in dehydrogenation zone 17 are controlled to selectively convert all or as much as possible of the cycloparaffinic material in the distillate transportation fuel to cyclomonoolefinic material to the near substantial exclusion of conversion of any other desirable hydrocarbonaceous material.

Dehydrogenated distillate transportation fuel passing from the dehydrogenation bed 17 to disproportionation catalyst bed 21 has a substantial increase in cyclomonoolefinic content and a substantial decrease in cycloparaffinic hydrocarbon content. It is desired in disproportionation reaction zone 21, containing the disproportionation catalyst, to open the ring of the cyclic monoolefinic hydrocarbon. This is selectively done in the presence of a diluent hydrogen gas present in small quantities, supplied by conduit 23 and in the presence of a required stoichiometric quantity of ethylene or propylene supplied by conduit 25. The catalyst and reaction conditions are selectively chosen in the disproportionation zone sufficient to open the ring of the cyclomonoolefinic hydrocarbon and thereby result in production of an acyclic di-α-olefin hydrocarbon. The reactor effluent passing from disproportionation zone 21 to the hydrogenation zone containing catalyst in bed 27, has a substantial decrease in the amount of cyclic monoolefinic hydrocarbon and a substantial increase in the amount of acyclic di-α-olefinic hydrocarbon. At this point, the distillate transportation fuel is passed from disproportionation catalyst zone 21 to hydrogenation catalyst zone 27 to stabilize the distillate transportation fuel by saturation of the two terminal bonds of the acyclic di-α-olefin hydrocarbon. At this point in the unitary, multi-catalyst bed reactor, the combustion quality of the distillate transport fuel is not greatly enhanced relative to the end product in conduit 29, but hydrogenation is necessary to ensure that the double bonds of the acyclic di-α-olefin hydrocarbon do not polymerize and form gum deposits in the distillate transportation fuel. A standard hydrogenation catalyst is used in hydrogenation catalyst bed 27 and a quantity of hydrogen is added in conduit 31 to achieve a hydrogenation (actually a rehydrogenation of the original cycloparaffinic molecule) of the acyclic di-α-olefin at relatively mild temperatures and partial pressures of hydrogen. After passage through hydrogenation catalyst bed 27, the distillate transportation fuel has a much larger quantity of acyclic paraffinic hydrocarbons in comparison with the distillate transportation fuel added via conduit 13. It also has a greatly diminished quantity of naphthenes or cycloparaffinic hydrocarbons vis-a-vis the quantity existent in conduit 13.

Another embodiment of this invention resides in a common reactor or single stage process wherein the design of the reactor will have a physical admixture of dehydrogenation catalyst 17, disproportionation catalyst 21 and hydrogenation catalyst 27, all in physical admixture throughout the entire unitary catalyst bed. In this method of operation it is necessary to select operating conditions and undertaken precise adjustments which preferably range from a temperature of from about 500° to about 1000° F., a pressure of from about 0 to 1500 psig, a partial pressure of hydrogen of at least 100 psia and a gas hourly space velocity (GHSV) of from 200 to 800. While this common reactor technique will enhance the acyclic paraffinic content of the distillate transportation fuel, it will not most probably convert the same quantity of cycloparaffinic hydrocarbons to aliphatic paraffinic hydrocarbons as obtained via conduit 29 of FIG. 1 but, nevertheless, is an operative process embodiment of this invention.

It is also within the scope of this embodiment that the reaction zones are separate and distinct entities. FIG. 2 shows this flow scheme schematically. A feedstock 101, preferably a distillate transportation fuel (either an ATF, diesel fuel or kerosene), having a boiling point of 300° to 900° F. is added to the selective hydrotreating zone 105 having a standard hydrotreating catalyst, such as a cobalt molybdenum catalyst, which zone is maintained at conditions sufficient to excise or convert any heteroatoms (predominantly sulfur and nitrogen) in the distillate transport fuel in the presence of added hydrogen in conduit 103 to less nefarious components. Hydrotreating catalyst is present in hydrotreating bed 107. Hydrotreating effluent is removed from hydrotreating zone 107 in conduit 109 and passed to dehydrogenation zone 111 having access to a small quantity of diluent hydrogen via conduit 113 which is present to mitigate coking of the feed material on catalyst 115. It is also contemplated that a non-hydrotreated feedstock in conduit 117 may be added to hydrogenation catalyst bed 115 in dehydrogenation zone 111. The effluent from dehydrogenation zone 111 is passed via conduit 119 to disproportionation zone 121 having disproportionation catalyst 123 contained therein. Zone 121 is operated selectively to open the cyclomonoolefinic material derived from the dehydrogenation of the distillate transportation fuel in dehydrogenation zone 111 and convert the cyclomonoolefinic material to di-α-olefin hydrocarbon. This ring opening is accomplished in the presence of a diluent, such as hydrogen, supplied in conduit 125 and in the presence of an olefinic material such as ethylene, propylene or any other compounds, which, when added to disproportionation catalyst zone 121, functions as ethylene would function to form terminal olefinic bonds in the ring-opened cyclomonoolefinic hydrocarbon. The effluent from disproportionation zone 121 is passed by means of conduit 129 to hydrogenation zone 131 containing hydrogenation catalyst 133. A quantity of hydrogen is added in conduit 135 to ensure saturation of both terminal bonds of the acyclic di-olefinic molecule and thereby reduce potential for gum formation in the finished product, which is withdrawn in conduit 137.

It is also contemplated within the scope of this invention that the distillate transportation fuel in conduit 129, having an increased quantity of the di-α-olefinic hydrocarbons, be selectively cooled and treated to reduce the temperature for injection into the hydrogenation zone, which is undertaken under relatively mild conditions of hydrogenation.

What I claim as my invention:

1. A process for the selective upgrading of combustion quality of a distillate transportation fuel containing cycloparaffinic hydrocarbons said fuel being selected from the group consisting of aviation turbine fuel (ATF), diesel fuel and kerosene by:

(a) selectively dehydrogenating said cycloparaffinic hydrocarbons in the presence of a dehydrogenation catalyst and at dehydrogenation reaction conditions selective to convert said cycloparaffinic hydrocarbons to cyclomonoolefinic hydrocarbons;

(b) selectively ring opening by disproportionation of said cyclomonoolefinic hydrocarbons by contact with a hydrocarbon comprising ethylene in the presence of an olefin disproportionation catalyst and at disproportionation conditions selective to open said cyclomonoolefinic hydrocarbons to produce acyclic di-α-olefin hydrocarbons; and (c) selectively hydrogenating said acyclic di-α-olefin hydrocarbons in the presence of hydrogen and a hydrogenation catalyst to saturate said acyclic di-α-olefin hydrocarbons, at hydrogenation conditions effective to produce acyclic paraffinic hydrocarbons.

2. The process of claim 1 wherein said distillate transportion fuel is a diesel fuel or ATF having a boiling range of 300° F. to 650° F.

3. The process of claim 1 wherein said dehydrogenation catalyst comprises a noble metal supported on an inorganic oxide and where said dehydrogenation reaction conditions include a temperature of 500°–1500° F., a pressure of from 0 to 1500 psig and a gas hourly space velocity (GHSV) of from 200 to 1000.

4. The process of claim 1 wherein said dehydrogenation catalyst comprises a combination of a Group VIII and Group VIB metal deposited on an inorganic oxide support.

5. The process of claim 1 wherein said cyclomonoolefinic hydrocarbons comprise from $C_7$ to $C_{25}$ carbon atoms and wherein the cycloparaffin ring comprises from $C_5$ to $C_6$ carbon atoms.

6. The process of claim 1 wherein said disproportionation catalyst comprises a metal or combination of metals of Group VIB deposited on an inorganic oxide support.

7. The process of claim 1 wherein said disproportionation conditions include a temperature of from 300° to 1000° F., a pressure of from 0 to 500 psig and a gas hourly space velocity (GHSV) of from 200 to 1000.

8. The process of claim 1 wherein said acyclic di-α-olefin hydrocarbons comprise a diolefin having two double bonds, each in the terminal position, and a 3- to 8-carbon atom chain intermediate said terminal bond positions.

9. The process of claim 1 wherein said dehydrogenation catalyst comprises a Group VIII metal deposited on an inorganic oxide support.

10. The process of claim 1 wherein said hydrogenation conditions comprise a temperature of from 0° F. to 1000° F., a pressure of from 0 to 1000 psig, a hydrogen partial pressure of at least 100 psia and a gas hourly space velocity (GSHV) of from 200 to 1000.

11. The process of claim 1 wherein said ethylene is present in a stoichiometric relationship to said cyclomonoolefinic hydrocarbon of 0.1:1 to 100:1.

12. The process of claim 1 wherein said cyclomonoolefinic hydrocarbons comprise $C_7$ to $C_{25}$ hydrocarbons with but one double bond in each cyclic ring.

13. The process of claim 1 wherein said dehydrogenation said disproportionation and said hydrogenation are effected in a common reaction zone having a physical admixture of said dehydrogenation, disproportionation and hydrogenation catalysts and wherein said zone is maintained at a temperature of from 500° to 1000° F., a pressure of from about 0 to 1500 psig, a partial pressure of hydrogen of at least 100 psia and a gas hourly space velocity (GHSV) of from 200 to 1000.

14. A process for the selective conversion of cycloparaffinic hydrocarbons in the presence of non-cycloparaffinic hydrocarbons which comprises:

(a) contacting said cycloparaffinic and non-cycloparaffinic hydrocarbons with a dehydrogenation catalyst at dehydrogenation conditions selected to convert said cycloparaffinic hydrocarbons to cyclomonoolefinic hydrocarbons to the substantial exclusion of conversion of said non-cycloparaffinic hydrocarbons and recovering said non-cycloparaffinic hydrocarbons and said produced cyclomonoolefinic hydrocarbons; and (b) contacting said recovered non-cycloparaffinic hydrocarbons and said cyclomonoolefinic hydrocarbons with a disproportionation catalyst, at disproportionation conditions, selective to convert said cyclomonolefinic hydrocarbons, in the presence of a lower olefinic hydrocarbon, to a ring-opened acyclic di-α-olefin hydrocarbon to the substantial exclusion of conversion of said non-cycloparaffinic hydrocarbons.

15. The process of claim 14 wherein said ring-opened acyclic di-α-olefin hydrocarbons are hydrogenated in the presence of a hydrogenation catalyst and hydrogen and at conditions effective to hydrogenate, at hydrogen partial pressures, said acyclic di-α-olefin hydrocarbons to acyclic paraffinic hydrocarbons.

16. The process of claim 14 wherein said lower olefinic compound is ethylene or propylene.

17. The process of claim 14 wherein said lower olefinic compound is formed in situ by the reaction of hydrogen with methane and ethane.

18. The process of claim 14 wherein said dehydrogenation of step (a) is performed in the presence of hydrogen to reduce coking on said dehydrogenation catalyst.

19. The process of claim 14 wherein said cycloparaffinic hydrocarbons comprises $C_7$ to $C_{25}$ hydrocarbons characterized as having 5- to 6-carbon rings and said non-cycloparaffinic hydrocarbons comprise linear $C_7$–$C_{15}$ paraffins and linear $C_7$ to $C_{25}$ olefinic compounds.

20. The process of claim 14 wherein said dehydrogenation catalyst comprises a non-acidic noble metal supported on an inorganic oxide and where said dehydrogenation reaction conditions include a temperature of 500°–1500° F., a pressure of from 0 to 1500 psig and a gas hourly space velocity (GHSV) of from 200 to 1000.

21. The process of claim 14 wherein said dehydrogenation catalyst comprises a combination of a Group VII and Group VIB metal deposited on an inorganic oxide support.

22. The process of claim 14 wherein said cyclomonoolefinic hydrocarbons comprise $C_7$ to $C_{25}$ cycloolefins having but one double bond.

23. The process of claim 14 wherein said disproportionation catalyst comprises a metal or combination of metals of Group VIB deposited on an inorganic support.

24. The process of claim 14 wherein said disproportionation conditions include a temperature of 300° to 1000° F., a pressure of from 0 to 500 psig and a gas hourly space velocity (GHSV) of from 200 to 1000.

25. The process of claim 14 wherein said di-α-olefin hydrocarbons comprise diolefin having two double bonds, each in the terminal position, and from 2 to 13 carbon atoms intermediate said terminal bond positions.

26. The process of claim 14 wherein said dehydrogenation catalyst comprises a Group VIII metal deposited on an inorganic oxide support.

27. The process of claim 14 wherein said hydrogenation conditions comprise a temperature of 0° F. to 1000° F., a pressure of from 0 to 1000 psig, a hydrogen partial pressure of at least 100 psia and a gas hourly space velocity (GSHV) of from 200 to 1000.

28. The process of claim 14 wherein said ethylene is present in a stoichiometric relationship to said cyclomonoolefinic hydrocarbon of 0.1:1 to 100:1.

29. The process of claim 14 wherein said acyclic paraffinic hydrocarbon comprises $C_7$ to $C_{25}$ paraffinic hydrocarbons.

30. A three stage hydrocarbon conversion process for the selective conversion of cycloparaffins to acyclic paraffins, wherein said conversion is performed on a distillate transportation fuel selected from the group of diesel fuel, aviation turbine fuel and kerosene containing said cycloparaffins in a multiple stage apparatus comprising distillate fuel, ethylene and hydrogen inlets and three sequential reaction zones comprising a first dehydrogenation zone, a second disproportionation zone and a third hydrogenation zone wherein distillate fuel is added to said first dehydrogenation zone by means of said distillate fuel inlet, ethylene is added to said second disproportionation zone by means of said ethylene inlet and hydrogen is added to said third hydrogenation zone or both said third hydrogenation zone and said first dehydrogenation zone by means of a hydrogen inlet and a distillate transportation fuel outlet, wherein distillate fuel of higher combustion quality is removed from said outlet in comparison with the combustion quality of said distillate fuel passed through said distillate fuel inlet to said first dehydrogenation zone, which process comprises:

(a) passing said distillate transportation fuel containing said cycloparaffins to said first dehydrogenation zone containing a dehydrogenation catalyst and maintained at dehydrogenation conditions of from 500° to 1500° F., a pressure of from 0 to 1500 psig and a gas hourly space velocity (GHSV) of from 200 to 1000 sufficient to unsaturate said cycloparaffins and convert said cycloparaffins to cyclomonoolefins and removing said distillate transportation fuel having a decreased amount of said cycloparaffins and an increased amount of said cyclomonoolefins from said dehydrogenation zone;

(b) passing said distillate transportation fuel derived from said first dehydrogenation zone of step (a) to a second disproportionation zone and adding to said second disproportionation zone ethylene in a stoichiometric quantity of from 0.1:1 to about 100:1, wherein said second disproportionation zone contains a disproportionation catalyst and is maintained at disproportionation reaction conditions of from 300° to 1000° F., a pressure of from 0 to 1500 psig and gas hourly space velocity (GSHV) of 200 to 1000 sufficient to open the ring of said cyclomonoolefins and increase unsaturation to form a linear di-α-olefin and to produce a distillate transportation fuel having a decreased amount of cyclomonoolefins, as compared to the transportation fuel derived from step (a) and an increased quantity of di-α-olefins, said distillate transportation fuel being removed from said second disproportionation zone; and (c) passing said removed distillate transportation fuel from step (b) to a third hydrogenation zone and adding hydrogen sufficient to insure a hydrogen partial pressure of at least 200 psia, wherein said third hydrogenation zone contains a hydrogenation catalyst and is maintained at a temperature of from 0° to 1000° F, a pressure of from 0 to 1500 psig and a gas hourly space velocity (GHSV) of from 200 to 1000 sufficient to hydrogenate said terminal bonds of said di-α-olefin to produce acyclic paraffins and thereby to prepare a distillate transportation fuel having an increased quantity of acyclic paraffins and thereby an increase in the combustion quality of said distillate transportation fuel.

31. The process of claim 30 wherein said first dehydrogenation zone contains a hydrogen inlet and wherein hydrogen is added to said first dehydrogenation zone at a hydrogen partial pressure of from 1 to 300 psia to mitigate coking on said dehydrogenation catalyst.

32. The process of claim 30 wherein said dehydrogenation catalyst is comprised of a metal selected from Group VIII of the Periodic Table dispersed on an inorganic oxide support, wherein said catalyst is present in a non-acidic form.

33. The process of claim 30 wherein said dehydrogenation catalyst comprises a metal selected from the group consisting of a Group VIII metal, a Group VIB metal or a combination of said Group VIII and Group VIB metals.

34. the process of claim 33 wherein said catalyst is promoted by 5 to 15 wt % of an alkali or alkaline earth metal.

35. The process of claim 35 wherein said alkali earth metal comprises from about 5 to about 15 wt % of potassium oxide or sodium oxide.

36. The process of claim 30 wherein said dehydrogenation conditions include a temperature of about 800° to 1000° F., a pressure of 0 to 500 psig and a gas hourly space velocity (GHSV) of from 500 to 1000.

37. The process of claim 30 wherein said disproportionation reactor is maintained at a temperature of from about 600° F. to 900° F., a pressure of 200 to 600 psig and a gaseous hourly space velocity (GHSV) of from 3 to 100.

38. The process of claim 38 wherein said disproportionation conditions also include a hydrogen partial pressure of at least 10 psig, wherein said hydrogen partial pressure functions as a diluent gas.

39. The process of claim 30 wherein said disproportionation catalyst comprises from about 5 to about 15 wt % of a Group VIII metal dispersed on an inorganic oxide support.

40. The process of claim 34 wherein said Group VIB metal comprises 5 to 15% of molybdenum trioxide or tungsten trioxide dispersed on a support selected from the group consisting of silica or a mixture of silica and alumina.

41. The process of claim 30 wherein said disproportionation catalyst comprises a Group VIII metal having from about 1 to about 5 wt % and a Group VIB metal having from about 5 to 15 wt % on an inorganic oxide support.

42. The process of claim 30 wherein said hydrogenation catalyst comprises 0.1 to 3 wt % of a Group VIII metal or 1 to 20 wt % of a Group VIB metal or a combination of said quantities of said Group VIII and Group VIB metal present on a support comprising an inorganic oxide.

43. The process of claim 30 wherein said hydrogenation conditions include a temperature of from about 200° to 600° F., a pressure of from about 500° to about 1000° psig, a hydrogen partial pressure of above 300 psia and a gaseous hourly space velocity (GHSV) of from 200 to 1000.

44. The process of claim 30 wherein said cycloparaffins comprise $C_7$ to $C_{25}$ cycloparaffins.

45. The process of claim 30 wherein said cyclomonoolefins comprise $C_7$ to $C_{25}$ cyclomonoolefins.

46. The process of claim 30 wherein said di-α-olefin comprise two terminal unsaturated bonds with from 2 to 13 carbon atoms intermediate said terminal unsaturated bonds.

47. The process of claim 30 wherein said acyclic paraffins comprise from $C_7$ to $C_{25}$ saturated acyclic paraffins.

48. The process of claim 30 wherein said three-stage hydrocarbon conversion process is, performed in three separate respective vessels comprising a first hydrogenation zone, a second disproportionation zone and a third dehydrogenation zone.

49. The process of claim 30 wherein said first dehydrogenation zone, said second disproportionation zone and said third hydrogenation zone are maintained within a unitary reaction vessel having three segregated interconnected zones comprising said first dehydrogenation zone, said second disproportionation zone and said third hydrogenation zone.

50. A process for the selective upgrading of combustion quality of a distillate transport fuel in a common single stage process vessel which comprises: passing said distillate transportation fuel to said vessel containing a tripartite-functioning catalyst having hydrogenation, dehydrogenation and disproportionation functions and maintained at a temperature of from about 500° to 1000° F., a pressure of about 0 to 1500 psig, a partial pressure of hydrogen of at least 1000 psia and a gas hourly space velocity (GHSV) of from 200 to 1000 to selectively convert cycloparaffinic hydrocarbons contained in said distillate transportation fuel to acyclic hydrocarbons by first dehydrogenating said cycloparaffins to cyclomonoolefins, disproportionating said cyclomonoolefins to di-α-olefins, in the presence of added ethylene to said vessel, and selectively hydrogenating said di-α-olefins in the presence of hydrogen to saturate said di-α-olefins and to thereby produce said acyclic paraffinic hydrocarbons.

51. A process of claim 50 wherein said catalyst is a physical admixture of a dehydrogenation catalyst comprising 0.1 to 3 wt % of a Group VIII metal, a disproportionation catalyst comprising 5 to 15% of a Group VIB metal and a hydrogenation catalyst comprising a combination of a Group VIII and a Group VIB metal, all of which are deposited on inorganic oxide supports selected from the group consisting of silica, alumina and silica/alumina, wherein said catalyst is uniformly admised throughout said single stage vessel to selectively convert said cycloparaffinic hydrocarbons to acyclic paraffinic hydrocarbons by means of partial unsaturation of said cycloparaffins, disproportionation of said unsaturated hydrocarbons to a di-unsaturated, acyclic hydrocarbon and hydrogenation of the acyclic di-unsaturated hydrocarbon to said acyclic paraffinic hydrocarbons.

* * * * *